US009605458B2

(12) United States Patent
Aykas

(10) Patent No.: US 9,605,458 B2
(45) **Date of Patent: *Mar. 28, 2017**

(54) ADJUSTABLE CORNER FITTING WITH HOLDING ELEMENT

(71) Applicant: DORMA Deutschland GmbH, Ennepetal (DE)

(72) Inventor: Kenan Aykas, Ennepetal (DE)

(73) Assignee: DORMA DEUTSCHLAND GMBH, Ennepetal (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/958,721

(22) Filed: Dec. 3, 2015

(65) Prior Publication Data

US 2016/0160548 A1 Jun. 9, 2016

(30) Foreign Application Priority Data

Dec. 4, 2014 (EP) ..... 14196234

(51) Int. Cl.
*E05D 5/02* (2006.01)
*E05D 7/081* (2006.01)
(Continued)

(52) U.S. Cl.
CPC ..... *E05D 7/081* (2013.01); *E05D 5/0246* (2013.01); *E05D 7/04* (2013.01); *E05D 15/54* (2013.01);
(Continued)

(58) Field of Classification Search
CPC . E05D 5/0246; E05D 5/02; E05D 2005/0261; E05D 2005/0269;
(Continued)

(56) References Cited

U.S. PATENT DOCUMENTS 3,828,394 A * 8/1974 Horgan, Jr. ..... E05D 5/0246 16/241
4,142,272 A * 3/1979 Oogami ..... E05D 7/0423 16/245
(Continued)

FOREIGN PATENT DOCUMENTS

DE 8536840 U1 2/1990
EP 0035143 A2 9/1981

OTHER PUBLICATIONS

U.S. Appl. No. 14/958,721, Aykas, Kenan, Chuck Mah.*

*Primary Examiner* — Chuck Mah
(74) *Attorney, Agent, or Firm* — Cantor Colburn LLP

(57) ABSTRACT

An adjustable corner fitting for a door element is disposed on a center of rotation and/or an axis, including first and second fitting elements, which, at least sectionwise, each include a locating portion for the abutment against the door element and are interconnectable while restraining the door element. A restraining area is formed between the two fitting elements, into which the door element is insertable, and the fitting elements are formed such that a holding element is disposed between both fitting elements, which is displaceable in relation to the fitting elements. A holding element is in operative connection with the connecting element, which serves for supporting the door element on the center of rotation and/or the axis. An attaching mechanism is incorporated at least at the holding element and at least at the connecting element, which is transferable between a released condition and a fixing condition, wherein, in the released condition, the holding element is displaceable at the fitting elements. In the fixing condition, it is non-positively and/or positively attached at least to one fitting element.

15 Claims, 4 Drawing Sheets

(51) Int. Cl.
*E05D 7/04* (2006.01)
*E05D 15/54* (2006.01)

(52) U.S. Cl.
CPC ... *E05D 2007/0484* (2013.01); *E05Y 2600/12* (2013.01); *E05Y 2600/502* (2013.01); *E05Y 2800/672* (2013.01); *E05Y 2900/132* (2013.01)

(58) Field of Classification Search
CPC ... E05D 2005/0253; E05D 7/081; E05D 7/08; E05D 7/082; E05D 7/084; E05D 7/04; E05D 7/043; E05D 7/083; E05Y 2900/114; E05Y 2600/502; E05Y 2600/60; E05Y 2800/672; E05F 11/385; E06B 3/54; A47K 3/362; A47K 2003/367; A47F 3/12; A47F 3/125; Y10T 16/534; Y10T 16/5326; Y10T 16/554; Y10T 16/5323
See application file for complete search history.

(56) References Cited

U.S. PATENT DOCUMENTS 4,200,956 A * 5/1980 Ullman, Jr. ..... E05D 5/0246 16/235
4,209,946 A * 7/1980 Akai ..... E05D 7/0423 16/245
4,513,474 A * 4/1985 Watabe ..... E05D 5/046 16/243
4,689,853 A * 9/1987 Marinoni ..... E05D 5/0246 16/382
4,977,642 A * 12/1990 Marinoni ..... E05D 5/0246 16/257
5,203,115 A 4/1993 Marinoni
5,483,770 A * 1/1996 Marinoni ..... E05D 7/0423 16/229
5,613,276 A * 3/1997 Franz ..... A47K 3/36 16/229
6,178,595 B1 * 1/2001 Marinoni ..... E05D 5/0246 16/252
7,493,673 B2 * 2/2009 Garrett ..... E05D 5/0246 16/252
8,528,169 B1 * 9/2013 Yu ..... E05F 3/20 16/238
8,578,556 B1 * 11/2013 Yu ..... E05F 3/104 16/240
2003/0213103 A1 * 11/2003 Cameron ..... A47K 3/36 16/382
2006/0277716 A1 * 12/2006 Sprague ..... A47K 3/36 16/252
2013/0185896 A1 * 7/2013 Yu ..... E05F 3/104 16/55

* cited by examiner

ADJUSTABLE CORNER FITTING WITH HOLDING ELEMENT

CROSS REFERENCE TO RELATED APPLICATIONS

This application is related to and claims the benefit of European Patent Application No. 14 196 234, filed on Dec. 4, 2014, the contents of which are herein incorporated by reference in their entirety.

TECHNICAL FIELD

The present disclosure relates to a corner fitting and a method for disposing a door element on a center of rotation and/or an axis via a corner fitting.

BACKGROUND

Conventional corner fittings serve for disposing door elements, in particular glass doors, such as for example double-action glass doors or sliding glass doors, on a center of rotation and/or an axis, for example a floor door closer axis (BTS-axis). Most of the time, the prior art corner fittings consist of two fitting elements, between which the door element, for example a glass door, is clamped between locating portions of the fitting elements. In addition, it is known to adapt the corner fittings to different glass cutout standards. For this purpose, in addition to the glass cutout corresponding to the standard glass cutout located in the corner area, where the fitting elements are clamped to, the door elements include additional bores, through which the attaching means pass, which reach abutment against the fitting elements, respectively connect the fitting elements to the door element. The cutouts in the corner area of the door element serve for forming a free space between the fitting elements outside the locating portions. Said free space is required for disposing, respectively for mounting the door element on a center of rotation and/or an axis via a connecting element, which is a structural component of the corner fitting and which is preferably disposed between the fitting elements.

It is disadvantageous in the prior art corner fittings that the connecting element, by means of which the door element, which is restrained between the locating portions, is supported on the center of rotation and/or the axis, is mostly configured integrally with the corner fitting, respectively the connecting element can just be utilized for disposing the door element on standardized centers of rotation and/or axes in order to guarantee a perfect mounting of the door element.

Therefore, the disclosure overcomes the above-described disadvantages of the state-of-the-art at least partially. Specifically, the disclosure provides a corner fitting for door elements, which allows for a perfect mounting and alignment of the door element restrained in the corner fitting also on non-standard centers of rotation and/or axes.

SUMMARY

Features and details, described in conjunction with the inventive corner fitting are obviously also valid in conjunction with the inventive method, and respectively vice versa, such that mutual reference is made, respectively can be made with respect to the disclosure of individual aspects of the disclosure.

The inventive corner fitting for a door element to be disposed on a center of rotation and/or an axis, including a first fitting element and a second fitting element, which each include at least partially a locating portion for the abutment against the door element and are connectable to each other while restraining the door element, includes the technical teaching that a restraining area forms between both fitting elements, into which the door element can be inserted, and that the fitting elements are configured such that a holding element is disposed between both fitting elements, which is displaceable in relation to the fitting elements and wherein the holding element is in operative connection with a connecting element, which serves for supporting the door element on the center of rotation and/or the axis, wherein an attaching mechanism, which can be transferred between a released condition and a fixing condition, is incorporated at least in the holding element and at least at the connecting element, wherein in the released condition, the holding element is infinitely variably displaceable at the fitting elements, and in the fixing condition it is non-positively and/or positively connected at least to one fitting element.

On the one hand, this solution offers the advantage that the connecting element is connected to the holding element, which allows for the infinitely variable adjustment of the door element on non-standardized centers of rotation. Said two structural components connected to each other preferably form the attaching mechanism, which is advantageously incorporated at both structural components, namely at the holding element and at the connecting element, and which mechanism can be transferred between a released condition and a fixing condition, wherein the holding element is displaceable at the fitting elements in the released condition, and in the fixing condition, it is at least non-positively and/or positively attached to at least one fitting element. Accordingly, on the one hand, the attaching mechanism formed at the holding element and at the connecting element serves for infinitely variably adjusting the corner fitting on a center of rotation and/or an axis, i.e. for infinitely variably displacing the holding element and the connecting element connected to the holding element, in particular in relation to the longitudinal extension of the fitting elements. Moreover, the attaching mechanism serves for fixing the corner fitting in the adjusted position, namely for fixing the holding element via the attaching mechanism at least at one of the fitting elements at least non-positively and/or positively. Accordingly, for adjusting the connecting element on the center of rotation and/or the axis, the holding element can be freely displaceable with the connecting element, i.e. according to the disclosure, it can be guided to be infinitely variably displaceable with regard to the longitudinal extension of the fitting element. Once the position of the connecting element is adjusted to the center of rotation and/or the axis, immobilizing the holding element and thereby also at least indirectly the fitting element is realized via the attaching mechanism by means of a non-positive clamped connection with at least one of the fitting elements via the holding element, which is preferably configured as a clamping plate.

For establishing a connection between the holding element and the connecting element, i.e. for forming the attaching mechanism, the holding element and the connecting element are particularly advantageously non-positively and/or positively connected to each other via at least one attaching element. The attaching element between the holding element and the connecting element may be for example a screw, such as e.g. a headless screw, which connects the holding element and the connecting element to each other. Particularly advantageously, at least two attaching elements are provided, which connect the holding element to the connecting element. The non-positive and/or positive connection between the holding element and the connecting element, i.e. the transfer of the attaching mechanism from the released condition into the fixing condition, serves in addition in an advantageous manner for immobilizing the holding element at the attaching element. For this purpose, the attaching element includes preferably a free space as a guide, for example in the shape of a recess, a groove or a rail, at which, respectively in which the holding element is guided, respectively supported to be movable. Advantageously, in this case, the free space in the fitting element is configured such that the holding element is displaceable, respectively guidable in longitudinal extension of the fitting element. As the fitting element, respectively the fitting elements of the corner fitting are aligned parallel to the front and/or rear surfaces of the door element, the displacement of the holding element in longitudinal extension of the fitting element causes a displacement of the door element with the fitting element in the opposite direction to the displacement of the holding element in longitudinal extension of the fitting element. Thereby, it becomes possible to align the door element, for example within a door casing to the long sides of the casing and on the center of rotation and/or the axis. If said displaceability of the door element in relation to the center of rotation was not given, for example a double-action door, adjusted on a firm center of rotation and/or a firm axis, would unintentionally contact a wall or another structural glass element with one of its edges, in case of an incorrect position of the center of rotation and/or the axis. In the event an abutment of the double-action door is configured at least partially at another glass door element or at the wall, in case of incorrect adjustment of the corner fitting or in case of incorrect position of the center of rotation and/or the axis, the door element could pivot past the abutment.

In advantageous manner, the free space configured as a recess, a groove or a slot, is provided in both fitting elements. The recess, the groove or the slot extend in this case in advantageous manner in longitudinal extension of both fitting elements and extend in the two fitting elements preferably at the same height and parallel to each other. The free space in the fitting elements referred to as recess, groove or slot, advantageously serves for guiding the holding element essentially parallel to the fitting elements and in relation to the longitudinal extension thereof. Advantageously, for this purpose the holding element includes the head part, which serves for supporting the holding element, at least in the released condition of the attaching mechanism, to be movable in the free spaces of both fitting elements. Based on this configuration, in the fixing condition of the attaching mechanism, clamping the holding element via the head part is effective at both fitting elements, namely respectively in the recesses of both fitting elements, whereby the clamping force acting during clamping is advantageously distributed equally to both fitting elements.

In advantageous manner, the attaching mechanism is configured such that in the released condition a static friction is effective between the holding element and the recess, which is considerably lower than the static friction, which is effective in the fixing condition between the holding element and the recess. Preferably, the attaching element and even more preferred two attaching elements serve for increasing the static friction from the released condition into the fixing condition of the attaching mechanism, via which attaching elements the static friction is adjustable between the recess and the holding element. If for example the attaching element configured as a screw is screwed into the holding element via the connecting element, preferably the static friction is increased between the holding element and the recess. When unscrewing the attaching element, the static friction between the holding element and the recess is advantageously lowered and the attaching mechanism is transferred into the released condition.

Advantageously, the static friction between the holding element and the recess is increased until the holding element is fixed at least at one of the fitting elements via the attaching mechanism. In this case, advantageously in the fixing condition, a clamping acts between the holding element and the recess, wherein the clamping prevents a movement of the holding element in relation to the fitting element. With the clamping and the fixed positioning of the holding element in the fixing condition of the attaching mechanism, advantageously also the connecting element in operative connection with the holding element is fixed in its position in relation to the fitting elements.

Based on a compact embodiment of the inventive corner fitting requiring only little constructional space, the attaching mechanism is preferably configured in that, during the transfer from the fixing condition into the released condition and vice versa, the holding element performs a stroke movement within the free space. As the attaching mechanism is advantageously incorporated in the holding element and in the connecting element, no additional structural components are required for forming the attaching mechanism. In this case, advantageously, in addition to serving for infinitely variably guiding the holding element in longitudinal extension to the fitting elements, the free space, configured as a recess in the fitting elements, also serves for accommodating the holding element in an at least clamping manner and namely advantageously at any position in the recess.

Advantageously, the holding element is configured as an L-profile with a head part and a connecting part, preferably in the shape of two surfaces essentially orthogonally to each other, wherein the head part is supported in the free space configured as a groove, slot or as a recess in one of the fitting elements to be movable in the released condition of the attaching mechanism, and in the fixing condition of the attaching mechanism acts in a clamping manner in the recess. In the event both respective fitting elements have a free space configured as a groove, slot or recess, the head part of the holding element, respectively the holding element is advantageously configured as a T-profile, for supporting the holding element to be movable in both recesses of the fitting elements, respectively for clamping it. By transferring the attaching mechanism from its released condition into the fixing condition, the holding element configured as a T-profile offers at least sectionwise a resting surface on both sides, i.e. in both free spaces configured as a groove, slot or recess of the fitting elements, which surface serves for the non-positive and/or positive connection between the holding element and the fitting elements. In this case, preferably in the fixing condition of the attaching mechanism, the head part of the holding element acts in a clamping manner in grooves, slots or recesses. In contrast to the holding element configured as an L-profile, the holding element configured as a T-profile clamps equally on both sides of the corner fitting, namely at both fitting elements. Thereby, it is possible to achieve a more stable non-positive and/or positive connection, i.e. an improved clamping action between the holding element and the fitting elements, with the holding element configured as a T-profile compared to the holding element configured as an L-profile. As also already described for the holding element configured as an L-profile, in the holding element configured as a T-profile, the connecting element is connected to the holding element via a connecting part.

Preferably, the connecting part and the head part of the holding element are configured as a common, monolithic and/or integral structural component. In this case, for example a structural component manufactured in an injection molding process from one or more different components can be understood as a monolithic structural component. A structural component manufactured from a material, which for example is carved out from a material block by milling, for example a material block, for example a metal block, can be understood as an integral structural component. Preferably, a common structural component is understood in that the head part and the connecting part are configured as individual parts, which are provided as a common structural component, namely as the holding element in a pre-mounted condition.

For adjusting the attaching mechanism, in particular for transferring the attaching mechanism from the released condition into the fixing condition and vice versa, preferably the attaching element is disposed at the connecting element to be accessible for the user from outside. As the connecting element is in operative connection with the holding element, which is guided between the fitting elements, and is therefore difficult to access, advantageously via the attaching elements, which can be manipulated from outside at the connecting element, the attaching mechanism and in particular the holding element can be transferred from the fixing condition, i.e. from the clamping with the free space configured as a recess, into the released condition, i.e. for establishing the infinitely variable displaceability in longitudinal extension of the fitting elements, and vice versa.

So that the holding element is able to perform a stroke movement preferably by means of the attaching elements disposed at the connecting element, which are accessible for the user, and for building the attaching mechanism incorporated at the holding element and at the connecting element, the holding element includes at least one bore, into which, in the fixing condition, the attaching element engages at least partially, whereby an increased clamping is caused between the holding element and the recess. Preferably, in the released condition, the attaching element engages far less deep into the bore or is located spaced apart from the bore, so that the clamping is lower or the clamping is almost rescinded.

With the intention to make the attaching element accessible from outside at the connecting element, the connecting element has at least one through-hole, in which the attaching element is disposed, wherein the through-hole extends in particular as far as to the bore. For configuring the attaching mechanism, which comprises a stroke movement of the holding element, preferably, in the released condition, the through-hole is not aligned flush with the bore at the holding element.

For moving the bore in relation to the through-hole for generating a stroke movement of the holding element, advantageously, the bore includes means, which cause the connecting part to move vertically to the direction of movement, when the attaching element engages in the bore. The measure of engagement of the attaching element in said bore is decisive for the measure of the stroke movement of the holding element. In case the attaching element engages less deep into the bore or in case the attaching element is spaced apart from the bore, i.e. unscrewed from the bore, preferably, the holding element performs a stroke movement in vertical direction from the attaching element and reaches the released condition. For clamping the holding element, the attaching element engages further into the bore, wherein, via means such as for example the configuration of the bore with a chamfer, which inclines from the border of the bore to the center of the bore, the holding element is pulled vertically to the direction of movement of the attaching element towards the attaching element and reaches clamping in the recess. As the through-holes serve for passing through the attaching elements, and advantageously, the attaching elements are screws, preferably the through-hole has an internal thread, which serves for the non-positive and/or positive connection to the attaching elements configured as screws. As the bore, respectively the bores of the holding element are not aligned with the through-holes of the connecting element and the bores are for example chamfered to the outside, the attaching element guided in the internal thread of the through-hole is pushed, respectively rotated along the chamfer of the bore. However, as the internal thread of the through-hole serves as a thrust bearing for the attaching element, the holding element is moved along the chamfer with the advance of the attaching element, in particular vertically to the direction of movement of the attaching element. In this case, the holding element guided in the free space configured as a recess in the fitting element reaches non-positive abutment at the recess.

With the intention to increase the advance of the attaching element along the means configured as a chamfer, respectively to guarantee said advance, preferably, in the frontal area, which reaches engagement with the bore, the attaching element has a cone-shaped surface, which almost corresponds to slope of the chamfer, respectively is adapted to the chamfer.

As already described, by bringing the attaching element in engagement with the bore of the holding element, i.e. it is moved with the advance of the attaching element into the bore of the holding element. Advantageously, in this case, the movement of the holding element is understood as vertically to the displaceability thereof in longitudinal extension of the fitting elements. In an even more preferred manner, the vertical displacement of the holding element is understood that bringing the attaching element in engagement with the bore causes the holding element to reach at least sectionwise non-positive and/or positive abutment with one of its surfaces at or in the free space configured as a recess respectively guide, respectively the clamping between the free space and the holding element is rescinded.

Obviously, it is also conceivable that the bore itself includes an internal thread for the non-positive and/or positive connection to the attaching element. Obviously, the through-hole in the connecting element may be then optionally embodied as a bore with internal thread or without internal thread, through which the attaching element is advanced in the direction of the bore of the holding element.

Preferably, by bringing the attaching element in engagement with the bore, the holding element is moved vertically with regard to the parallel guide. The vertical movement of the holding element immobilizes the latter, via at least one engagement portion, which is configured at one of the surfaces of the holding element, at least at one fitting element. Preferably, in this case, the engagement portion of the holding element comprises a portion of a surface of the holding element, which portion is guided in the recess, respectively in the free space and is located in particular at the head part of the holding element. In the event according to the disclosure, the connecting element is non-positively and/or positively coupled to the holding element, the engagement portion is non-positively and/or positively coupled in or at the recess. A displacement of the connecting element to align of the door element on the center of rotation and/or the axis is therefore just possible by uncoupling the non-positive connection between the holding element and the fitting element. The non-positive uncoupling of the holding element from the fitting element is realized in this case and as already mentioned by releasing the non-positive and/or positive connection between the connecting element and the holding element. Accordingly, the non-positive uncoupling between the holding element and the fitting element is released in that the attaching element is pushed respectively rotated out of the bore, and by a vertical movement of the holding element, releases the holding element from the clamped position into released position. So that the holding element can be again non-positively connected to the fitting element, the fitting element needs to be advanced in the direction of the bore. When advancing the attaching element into the bore, the holding element is then moved in the opposite vertical direction, whereby the engagement portion at the head part of the holding element is being non-positively connected to the fitting element and the holding element is located in its clamped position.

In a preferred way, the free space is and/or the fitting elements are formed in this case in such a manner towards the holding element that a movement of the holding element along the longitudinal extension of the fitting element can be realized for up to 35 mm. Said configuration of the corner fitting allows for guaranteeing that an adjustment on centers of rotation and/or axes having a measure in the range from approximately 45 mm to approximately 80 mm is possible.

With the intention to increase the clamping effect, i.e. the friction between the holding element, i.e. the engagement portion of the head part and the free space configured as a recess in at least one of the fitting elements, and with the intention to establish in addition to a non-positive connection between the holding element and the attaching element, a positive connection as well between said two elements, in the area of the engagement portion, the surface of the holding element has advantageously a profile, a ribbing and/or an increased roughness. Advantageously in this case, the profile of the engagement portion is configured such that the clamping, respectively the friction between the holding element and the fitting element guarantees a form closure, which absorbs the torque via the door closer. Obviously, as an alternative or in addition, also the free space configured as a recess for example of the fitting element may include at least sectionwise a profile, which preferably corresponds to the profile of the engagement portion of the holding element, i.e. reaches mutual engagement with the latter.

In addition to the free space configured as a groove, as a slot or as a recess in longitudinal extension of the fitting elements in at least one of the fitting elements, preferably a free space in the shape of a distance between the fitting elements is formed, which allows for guiding the holding element between the fitting elements at least in relation to the longitudinal extension thereof, wherein the connecting part of the holding element extends through the distance. In this case, in a preferred manner, the free space formed as a distance between the fitting elements is configured to be larger than the material thickness of the connecting part. In a preferred manner, the distance ranges between 1% to 100% larger than the material thickness of the connecting part, wherein in a preferred manner, in particular based on a compact construction type of the inventive corner fitting, the distance is equal to or larger than 10% with regard to the material thickness of the connecting part. Accordingly, the holding element is movable in a second direction of movement orthogonally to a first direction of movement in longitudinal extension of the fitting elements. In this way, via the holding element also a plane offset of the center of rotation, respectively the axis might be compensated for, i.e. that a glass element rotatably supported by means of the inventive corner fitting on the center of rotation and/or the axis can be aligned flush for example from door to sidepanel or from door to center joint.

In the present application the following terms are understood as follows, however should not be understood as being limited thereto:

A structural component, which is movable essentially parallel to the fitting elements, i.e. displaceable and advantageously also rotatable, is understood as the "holding element" and which serves for displacing the connecting element, which is operatively connected to the holding element, parallel to the fitting elements and for aligning it with a door element restrained in a restraining area about a center of rotation and/or an axis. In this case, the holding element may be configured as a single-surface or multi-surface body. Obviously, the holding element may as well be configured of one or more struts connected to each other or otherwise, such as e.g. an angled part. The space available between the fitting elements and formed by the distance of the fitting elements to each other is the only limiting factor for the type and construction form of the holding element.

A structural component accommodating the center of rotation and/or the axis is understood as the "connecting element". For increasing the variability of the connecting element, said reception may have different sizes, respectively may be adaptable to receptions having different sizes, for example by means of adapter inserts. The connecting element may thus be a separate structural component, which is in operative connection with the holding element via attaching elements, or it may as well be embodied with the holding element as a common monolithic and/or integral structural component.

The "infinitely variable selection of centers of rotation" is understood to range between approximately 45 mm and 80 mm. Obviously, if required, the inventive corner fitting may be configured to allow for selecting centers of rotation outside the above-described range. However, this would require having to cut out the door element in a larger than usual area and the corner fitting would have to be dimensioned correspondingly to allow for expanding the displaceability of the holding element between the fitting elements.

A free space configured in the shape of grooves, small channels, furrows, shoulders, rails, protrusions, slots and/or for example roller belts, which allows for displaceable, i.e. mobile support of the holding element, may be understood as the "free space, which is configured as a recess in at least one fitting element". Obviously, latching means may be configured along the free space, which allow for the holding element to latch in and thus for a pre-adjustment of the door element to given measures of centers of rotation and/or measures of axes. However, it might be that just latching and/or stop centers are configured for standardized centers of rotation and/or the axes. In this case, an infinitely variable displaceability of the holding element in the free space is guaranteed advantageously between two latching means, respectively between two latching and/or stop centers, whereby a fine-tuning of the corner fitting is possible on non-standardized centers of rotation.

The inventive method for disposing a door element on a center of rotation and/or an axis via a corner fitting, in particular via the inventive corner fitting, including a first fitting element and a second fitting element, which each include at least sectionwise a locating portion for the abutment against the door element, and while restraining the door element are connected to each other, according to the disclosure, includes the technical teaching that the corner fitting includes an attaching mechanism, which can be transferred between a released condition and a fixing condition, wherein in the released condition a connecting element, which is supported in the corner fitting to be displaceable, can be aligned on the center of rotation and/or the axis and after aligning the connecting element on the center of rotation and/or the axis, the attaching mechanism is transferred into the fixing condition, such that the holding element is attached in a clamped manner at least at one fitting element, whereby a relative movement is excluded between the holding element and the fitting element.

With the intention to avoid repeating the advantages of the inventive method, it is referred to the description of the advantageous embodiment of the inventive corner fitting and it is fully and comprehensively referred to the latter.

BRIEF DESCRIPTION OF DRAWINGS

Hereinafter, further measures enhancing the disclosure will be illustrated in the following in detail in conjunction with the description of one preferred exemplary embodiment of the disclosure based on the Figures. In this context, the features mentioned, individually or randomly combined, may be essential to the disclosure.

In the drawings.

Throughout the different Figures, same parts are always identified by the same reference numerals, and therefore they will be normally only described once.

DETAILED DESCRIPTION OF DRAWINGS

Figure 1:
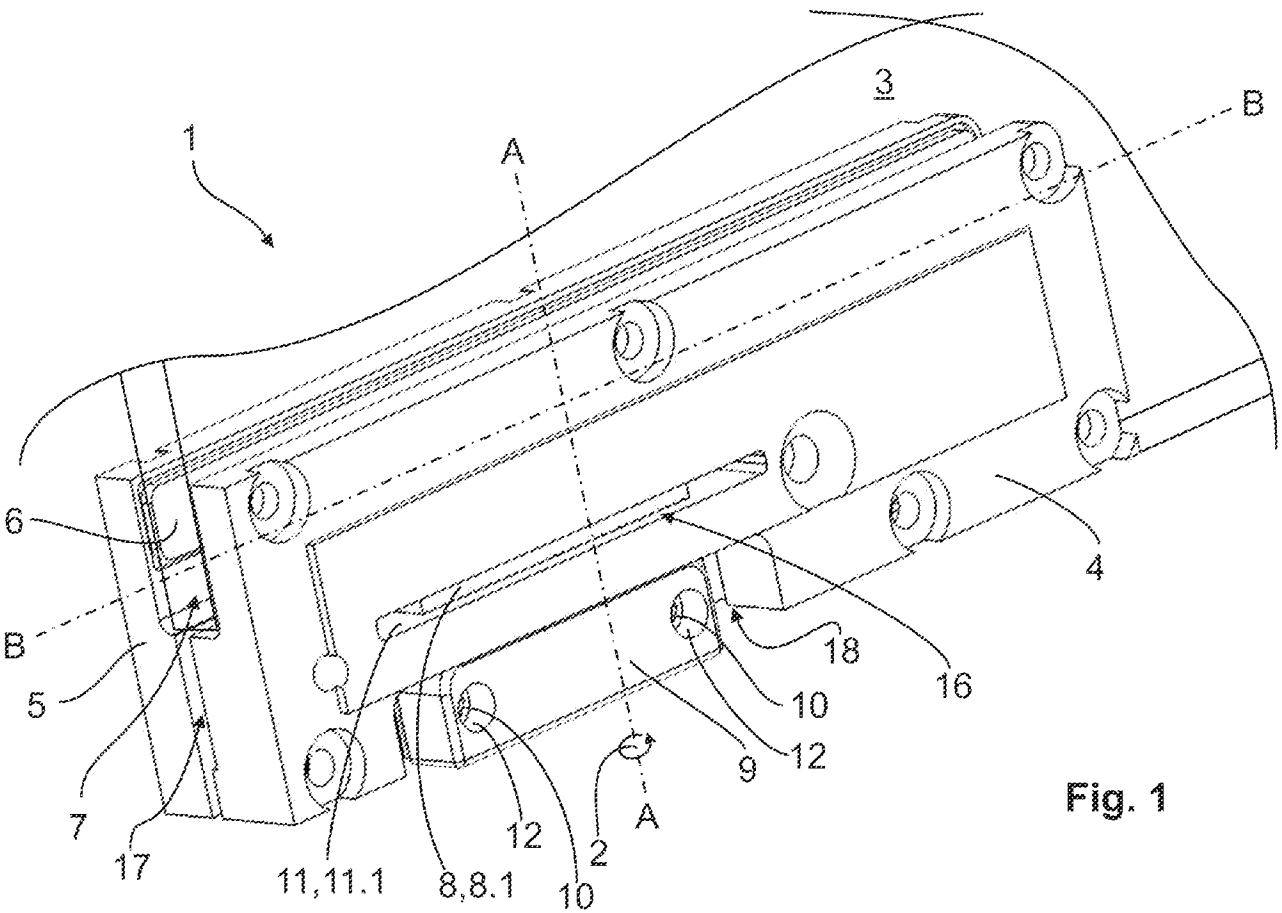
FIG. 1 shows an inventive corner fitting, which is clamped to the left lower corner of a door element, in a perspective side view.

FIG. 1 shows a door element 3, which, via a corner fitting 1, is supported on a center of rotation 2, which may be for example also a BTS-axis. At the lower left corner of the door element 3, the corner fitting 1 is clamped to the door element 3 via locating portions 6. The corner fitting 1 illustrated in FIG. 1 is configured such as to be also clampable to the top left or the top right or the lower right corner of the door element 3 for supporting the door element 3 on a center of rotation 2 and/or an axis. The corner fitting 1 consists of a first fitting element 4 and of a second fitting element 5. Both fitting elements 4 and 5 include locating portions 6, which serve at least for indirect abutment via an intermediate layer, not illustrated here, against the door element 3. A restraining area 7, into which the door element 3 is insertable, is formed between the fitting elements 4 and 5. A holding element 8, which is displaceable in relation to the fitting elements 4 and 5, in particular in longitudinal extension of the fitting elements 4 and 5, is disposed between the two fitting elements 4 and 5. A connecting element 9, which is operatively connected to the holding element 8, serves for supporting the door element 3 on the center of rotation 2 and/or the axis. In the present case, the connecting element 9 is non-positively and/or positively operatively connected to the holding element 8 via two attaching elements 10. The holding element 8 being in operative connection with the connecting element 9 is guided to be movable in the fitting element 4 and the fitting element 5 in a free space 11 configured as a recess 11.1 in the shape of a groove. In this case, the free space 11 is configured in the shape of a groove parallel to the longitudinal extension of the fitting elements 4 and 5. The holding element 8 and the connecting element 9, which is in operative connection via the attaching elements 10, are thereby displaceable parallel along the recess 11.1, i.e. with regard to, respectively in the longitudinal extension of the attaching elements 10. As the connecting element 9 with the holding element 8 is displaceable in relation to the door element 3 in the opposite direction, the door element 3 can be infinitely variably aligned on the center of rotation 2 along the axis BB, for example in its position in a door frame or a glass door installation. In the event e.g. the center of rotation 2, respectively the axis of rotation of the door element 3, represented by the axis AA, is located outside the areas determined for the usual centers of rotation 2, namely outside of 55 mm, 65 mm or 70 mm, the door element 3 may be aligned on the center of rotation and/or the axis by displacing the holding element 8 and thereby with the connecting element 9, which is operatively connected to the holding element 8. In the present case, the holding element 8 and the connecting element 9 are configured as two interconnected structural components comprising the attaching mechanism, which in the present case, is incorporated into both structural components, namely the holding element 8 and the connecting element 9. For transferring the attaching mechanism form the released condition, in which the holding element 8 is supported to be movable in the longitudinal extension of the fitting elements 4 and 5, into the fixing condition, the attaching elements 10, which connect the holding element 8 via the connecting part to the connecting element 9, are screwed into the through-holes 12. When screwing the attaching elements 10 into the connecting part 8.2, the holding element 8 performs a stroke movement, and gets clamped via a resting portion 16 at least sectionwise at least non-positively in the free space 11, configured as a recess 11.1 in the form of a groove, at the fitting elements. Thus, in the fixing condition of the attaching mechanism, the displaceability of the holding element 8 and of the connecting element 9 operatively connected to the holding element 8 is disabled, respectively the holding element 8 is immobilized in its position at the fitting elements 4 and 5.

With the intention to assist the infinitely variable displacement of the holding element 8 in longitudinal extension of the fitting elements 4 and 5, which holding element is connected to the connecting element 9 via the connecting part 8.2, a lower recess 18 is configured at the fitting elements 4 and 5, which is preferably formed parallel to the recess 11.1 formed as the free space 11 and preferably extends over the same length as the recess 11.1 configured as the free space 11. Preferably in this case, the lower recess 18 is formed in both fitting elements 4 and 5 and extends over the distance 17 of the fitting elements from the one to the other fitting element 4 and 5.

Figure 2:
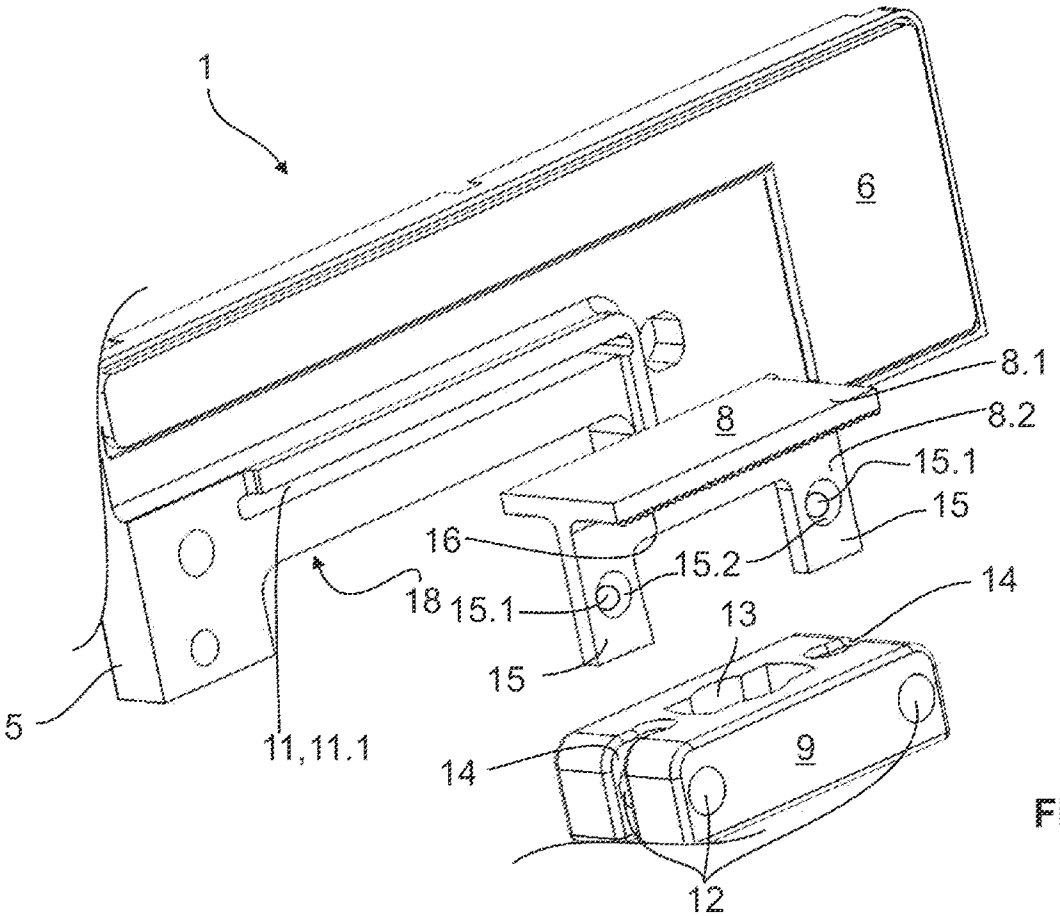
FIG. 2 shows the rear fitting element, the holding element and the connecting element in the non-mounted condition.

For a better illustration of the support of the holding element 8 in the corner fitting 1, FIG. 2 shows the corner fitting 1 without the front fitting element 4 in the non-mounted condition. As can be seen, outside the locating portion 6, the door element 3 includes a cutout according to the known glass cutout standards and, outside the cutout, bears against the locating portion 6 of the fitting element 5. A free space, which serves for disposing the holding element 8 and the connecting element 9, is created in the corner fitting 1 in the area of the cutout of the door element 3. As can be additionally seen in FIG. 2, the attaching mechanism just comprises the holding element 8 and the connecting element 9, which are non-positively and/or positively interconnected via two attaching elements 10 (not illustrated here), which can be manipulated through the through-holes 12 configured at the connecting element 9. The attaching elements 10, which are advantageously configured as screws or headless screws, pass through, respectively are screwed into the through-holes 12 in the shape of bores, which are configured in the connecting element 9. Together with the attaching elements 10 and the free space 11, the connecting element 9 and the holding element 8 form the attaching mechanism, which is transferable from an infinitely variably displaceable support of the holding element 8 in a released condition into a fixing condition, in which the holding element 8 is at least non-positively coupled to the fitting element. In the non-positive coupling of the holding element 8 to the fitting element 4 and/or 5, a positioning of the door element 3 can be indirectly immobilized via the alignment of the corner fitting 1 on the axis or the center of rotation. For this purpose, the connecting element 9, which is operatively connected to the holding element 8, has a reception 13 almost in the center, which serves for disposing the door element 3 on the center of rotation 2 and/or the axis. Advantageously in this case, the reception 13 is adaptable to the center of rotation 2 and/or the axis, for example by means of different adapters. As, in the present exemplary embodiment, the connecting element 9 is a single component of the corner fitting, with differently large dimensioned receptions 13, it may obviously be variably connected to the holding element 8 and thus comprise the attaching mechanism. For connecting the holding element 8 to the connecting element 9, the connecting element 9 has apertures 14 configured in the area of the through-holes 12, which serve for accommodating tappets 15, which are configured at the holding element 8 and are formed at the connecting part 8.2 of the holding element 8. The tappets 15 have respectively one bore 15.1, through which the attaching elements 10 engage, which are guided in the through-holes 12 of the connecting element 9. Preferably, the attaching elements 10 serve in this case for transferring the attaching mechanism, which is formed among others from the connecting element 9 and the holding element 8, into different functional conditions. On the other hand, the connecting element 9 and the holding element 8 are non-positively and/or positively connected via the attaching elements 10 and thereby form a pre-mounted integral structural component. The surface configured at the head part 8.1 of the holding element 8 is guided in the fitting element 5 in the free space 11 configured as a recess 11.1 in the shape of a groove. As can be seen, the bores 15.1 in the tappets 15 of the holding element 8 include respective means, in the present case in the shape of a chamfer, which serve for reducing respectively for increasing the bores 15.1. The function of the means 15.2 is illustrated in the FIGS. 4*a* and 4*b*.

Figure 3B:
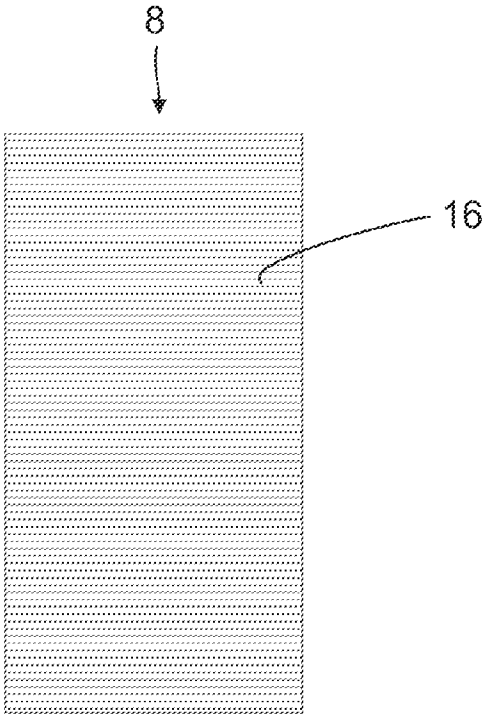
FIGS. 3*a* and *b*: show a detailed view in a top view on the underside of the head part of the holding element, and FIGS. 4*a* and *b*: show a diagrammatical sectional view of the movement of the holding element caused by the advance of the attaching element.
Figure 3A:
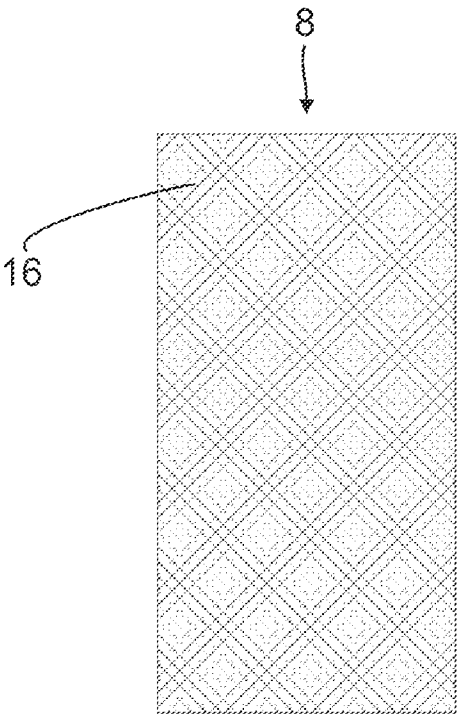

In a top view, FIGS. 3*a* and 3*b* show the underside of the head part 8.1 of the holding element 8 configured as a clamping part with an engaging, respectively resting portion 16. For increasing the clamping, i.e. the friction between the holding element, in particular between the engaging, respectively resting portion 16 and the recess 11, the engaging, respectively resting portion 16 includes a ribbing for example as illustrated in FIG. 3*a* a diamond-shaped ribbing. Another embodiment of the ribbing of the engaging, respectively resting portion 16 is shown in FIG. 3*b*, wherein a parallel ribbing is configured at the engaging, respectively resting portion 16, which is configured vertically to the longitudinal extension of the free space 11 configured as the recess 11.1. Obviously, the clamping of the holding element 8 configured as the clamping plate may just be realized via a non-positive connection, which however, is limited to a maximum torque transferred from the floor door closer onto the holding element 8 via the axis of rotation.

Figure 4B:
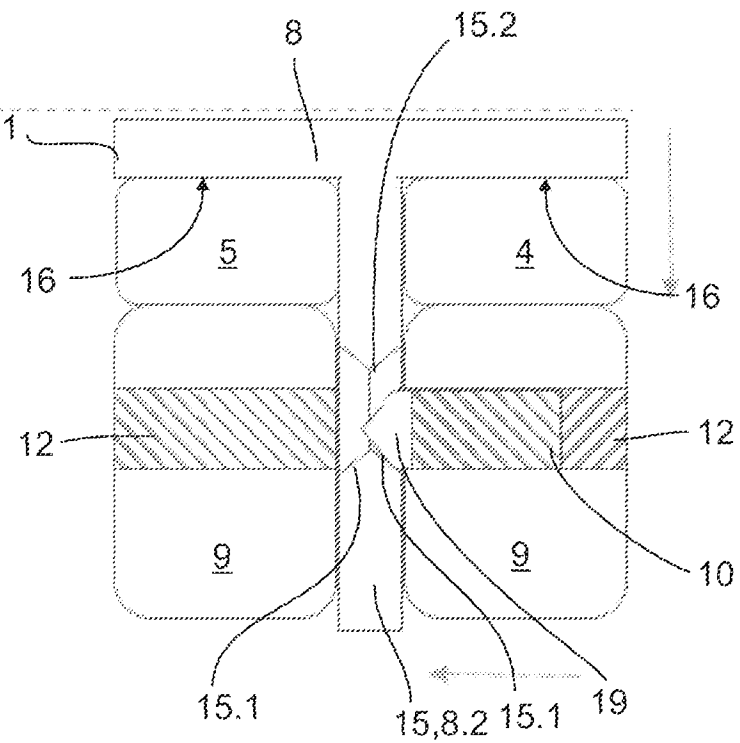
Figure 4A:
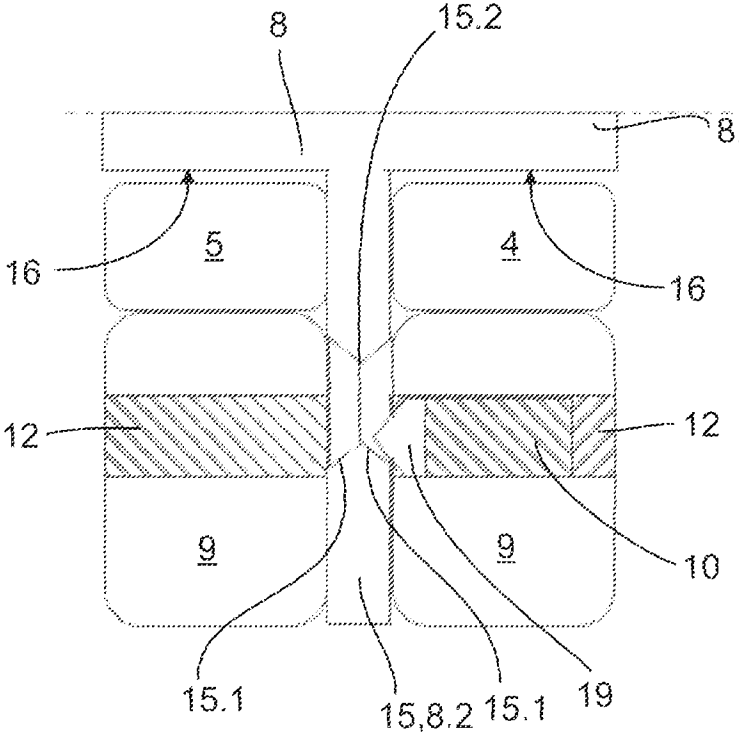

In a diagrammatical sectional view, FIGS. 4*a* and 4*b* show the holding element 8, which is configured in a T-shape as a T-profile. FIG. 4*a* shows in this case, the holding element 8, which in the released condition is freely displaceable, and FIG. 4*b* shows the holding element 8, which in the clamped position, respectively in the fixing condition is non-positively connected to the free space 11 configured as a recess 11.1 of the fitting element 4 and 5. The non-positive connection between the holding element 8 and the free space 11 configured as a recess 11.1 of the fitting element 4 and 5 is realized via the advance of the attaching element 10. As illustrated in FIG. 4*b*, the attaching element 10 is advanced in the direction of the bore 15.1, wherein the cone surface 15.1 configured at the attaching element 10 pushes against the means 15.2 configured as a chamfer in the bore 15.1, whereby the holding element 8 is pulled downwards, i.e. performs a stroke movement in vertical movement to the movement of the attaching element 10 and in orthogonal direction to the longitudinal extension of the fitting elements 4 and 5. The engagement of the attaching element 10, as illustrated here by means of the cone surface 15.1 running along the means 15.2 configured as a chamfer, realizes the non-positive and/or positive connection between the connecting element 9 and the holding element 8 and thereby realizes directly a non-positive and/or positive connection of the holding element 8, via the engaging, respectively resting portion 16, to the fitting element 4 and 5, and namely in particular by means of the stroke movement of the holding element vertically to the longitudinal extension of the fitting elements 4 and 5 and vertically towards the attaching element 10, i.e. along the axis AA illustrated in FIG. 1 as far as to the abutment of the engaging, respectively resting portion 16 against the resting surface configured by the free space 11.

The invention claimed is:

1. A corner fitting for a door element to be disposed on a center of rotation and/or an axis, including a first fitting element and a second fitting element, which are interconnectable while restraining the door element, wherein a restraining area forms between the fitting elements, into which the door element is insertable, and the fitting elements are formed such that a holding element is disposed between the fitting elements, which is displaceable in relation to the fitting elements, and the holding element is in connection with a connecting element, configured for supporting a door element on the center of rotation and/or the axis, wherein an attaching mechanism is incorporated at least at the holding element as well as at least at the connecting element, which is transferable between a released condition wherein the holding element is displaceable at the fitting elements, and a fixing condition wherein the holding element is non-positively or positively attached at least to one fitting element.

2. The corner fitting according to claim 1, wherein the holding element is displaceable along a longitudinal extension of the fitting element in a free space, wherein the free space includes a recess in at least one fitting element and the holding element is supported in the recess to be movable.

3. The corner fitting according to claim 2, wherein the attaching mechanism is configured such that in the released condition, a static friction is effective between the holding element and the recess, which is considerably lower than the static friction, which is effective in the fixing condition between the holding element and the recess.

4. The corner fitting according to claim 2, wherein in the fixing condition, a clamping between the holding element and the recess prevents a movement of the holding element in relation to the fitting element.

5. The corner fitting according to claim 4, wherein the attaching mechanism is configured such that during the transfer from the fixing condition to the released condition and from the released condition to the fixing condition, the holding element performs a stroke movement within the free space.

6. The corner fitting according to claim 2, wherein the recess extends along the longitudinal extension of the fitting element and the holding element is supported with a head part in the recess to be movable, wherein, in the fixing condition, the holding element with a resting portion located at the head part, abuts against the recess.

7. The corner fitting according to claim 6, wherein the holding element includes a connecting part, to which the connecting element is attached, via the attaching element, wherein the head part and the connecting part are aligned vertically to each other and/or form a monolithic or integral structural component.

8. The corner fitting according to claim 7, wherein the holding element is movable via the connecting part along the longitudinal extension of the fitting element in a free space in a first direction of movement, wherein the free space is configured such that the holding element is movable in a second direction of movement orthogonally to the first direction of movement.

9. The corner fitting according to claim 1, wherein a transfer from the fixing condition into the released condition and from the released condition to the fixing condition can be performed via an attaching element, which is disposed at the connecting element and is accessible for the user from the outside.

10. The corner fitting according to claim 1, wherein the holding element includes at least one bore, into which the attaching element engages at least partially in the fixing condition, whereby an increased clamping is effective between the holding element and the recess, and in the released condition, the attaching element engages far less into the bore or is located spaced apart from the bore such that the clamping is weaker or the clamping is almost rescinded.

11. The corner fitting according to claim 10, wherein the connecting element includes a through-hole, in which the attaching element is disposed, wherein the through-hole extends as far as to the bore, and in the released condition, the through-hole is not aligned flush with the bore.

12. The corner fitting according to claim 11, wherein the bore includes means, which, when the attaching element engages in the bore, cause the connecting element to move vertically to the direction of movement of the attaching element.

13. The corner fitting according to claim 11, wherein the bore and/or the through-hole include an internal thread with which the attaching element reaches non-positive or positive engagement.

14. The corner fitting according to claim 1, wherein in the fixing condition, the surface of the engaging, respectively resting portion and/or of the recess, which is effective at the engaging, respectively resting portion has a roughness and/or a ribbing.

15. A method for disposing a door element on a center of rotation and/or an axis via a corner fitting according to claim 1, including a first fitting element and a second fitting element, which are interconnected while restraining the door element, that the corner fitting includes an attaching mechanism, which is transferable between a released condition and a fixing condition, wherein, in the released condition, a connecting element, which is supported in the corner fitting to be displaceable, is aligned to the center of rotation and/or the axis, and after aligning the connecting element on the center of rotation and/or an axis, the attaching mechanism is transferred into the fixing condition such that the holding element is attached to at least one fitting element in a clamped manner, whereby a relative movement between the holding element and the fitting element is excluded.

* * * * *